United States Patent [19]

Evans et al.

[11] 4,200,859

[45] Apr. 29, 1980

[54] DEVICE FOR SIMULATING MARINE CRAFT NOISES

[75] Inventors: David J. Evans; Clark F. Bradley, both of San Diego, Calif.

[73] Assignee: The United States of America as represented by the Secretary of the Navy, Washington, D.C.

[21] Appl. No.: 656,104

[22] Filed: Apr. 21, 1946

[51] Int. Cl.[2] ..... H04K 3/00

[52] U.S. Cl. ..... 367/1; 35/10.4

[58] Field of Search ..... 35/25, 10.1, 10.4, 10.2; 114/21; 340/1-6, 16

[56] References Cited

U.S. PATENT DOCUMENTS

| | | | |
|---|---|---|---|
| 1,401,288 | 12/1921 | Sodeau et al. | 114/20 |
| 1,673,002 | 6/1928 | Fearing | 179/171.5 |
| 1,892,431 | 12/1932 | Hammond, Jr. | 114/21 W |
| 2,395,679 | 2/1946 | Neuhof | 35/10.1 |
| 2,397,107 | 3/1946 | Hammond | 35/25 |
| 2,413,350 | 12/1946 | Helmore | 114/21 |
| 2,710,458 | 6/1955 | Reed | 35/10.4 |

*Primary Examiner*—Richard A. Farley
*Attorney, Agent, or Firm*—G. J. Rubens

EXEMPLARY CLAIM

1. In combination in electronic apparatus for simulating the self-noise of a submarine, means for generating a wide-band noise signal, means for modulating the noise signal at a frequency corresponding to the propeller speed of a submarine, means for generating a signal at the frequency of the tooth impacts of the main drive gear of a submarine, and amplifying and output means for both said tones.

4 Claims, 8 Drawing Figures

DEVICE FOR SIMULATING MARINE CRAFT NOISES

The present invention relates to underwater sound apparatus, and particularly to artificial targets.

Objects of the invention include the provision of an improved artificial target suitable for use both as a decoy and also as a practice target, the provision of improved apparatus for the simulation of the self-noise of a submarine, and the provision of improved launching and retrieving means for a free, artificial target.

This device is adapted to be launched from a submerged submarine on a pre-determined course and at a pre-determined depth and, at a pre-determined time after launching, it begins generating noises that simulate the self-noise generated by a submerged submarine. At the same time the device repeats any echo-ranging pings of a searching ship that are directed at the device so as to simulate the reflecting characteristics of a submerged submarine.

The invention described herein is useful in training sound operators in the task of locating submerged submarines and it is useful also in combat as a decoy for misleading vessels that are searching with underwater detection gear for submerged submarines.

For training purposes the device is adjusted to remain submerged while simulating, in sound and movement, a submerged submarine, and after a run of approximately 20 minutes to rise to the surface to be recovered. It is adapted to be launched either from a submarine torpedo tube, or from a surface vessel or small boat.

For combat purposes the device may be launched from a submerged submarine that is under attack. When so used, it is adjusted to continue underway until its source of power is exhausted, and then to sink to the bottom so as to eliminate the possibility of the enemy ever discovering that a submarine decoy had been in the water. While the attention of the searching ship is thus diverted to the decoy the launching submarine may attempt an escape or an attack. In the drawings.

Figure 1:
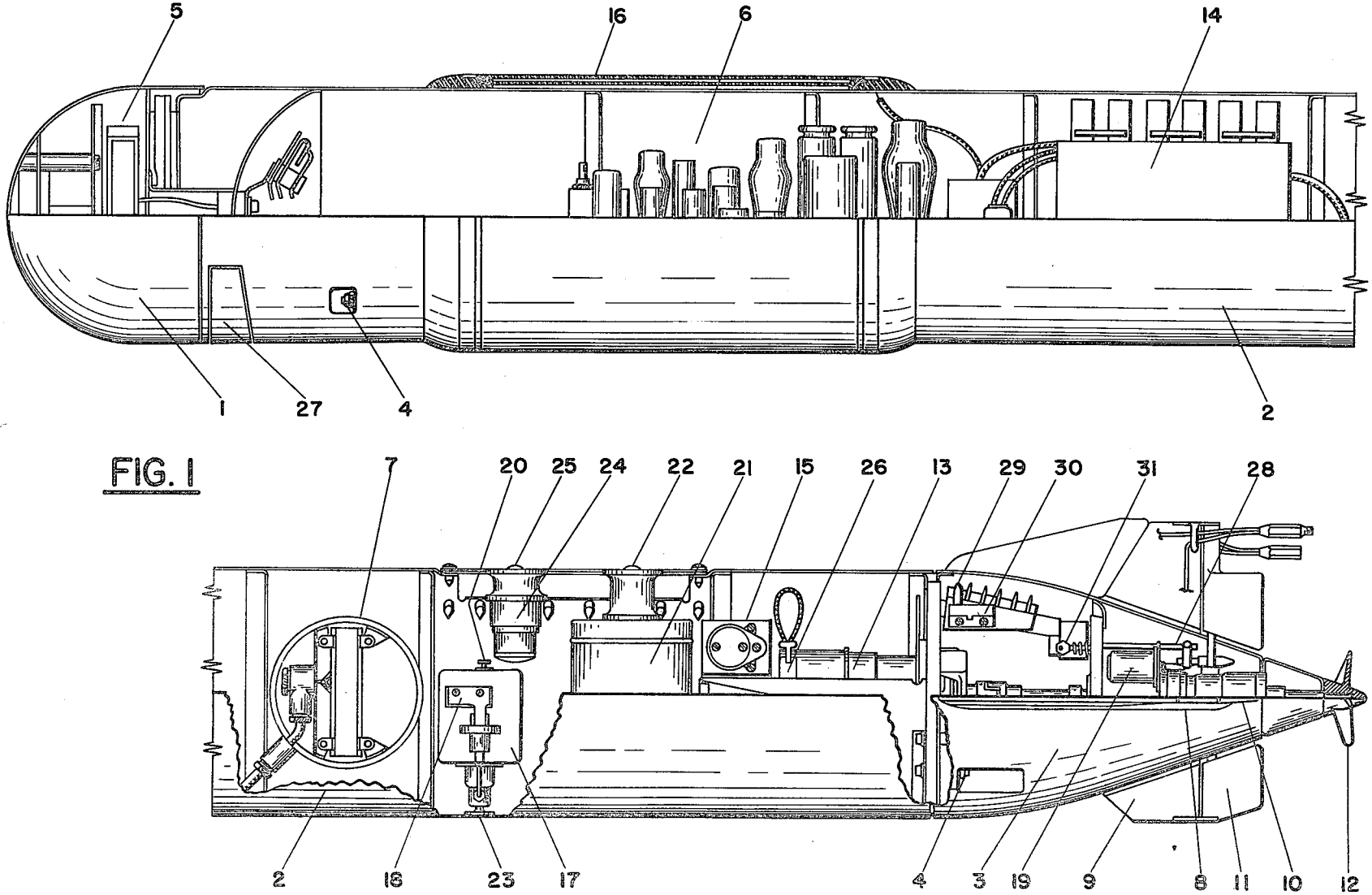
FIG. 1 is an elevation, partly in section, of the device of the present invention.

FIG. 1 shows the general arrangement of the artificial target of the present invention, which consists primarily of a nose section 1, main body section 2, and an afterbody section 3. The assembly of these sections forms a cylindrical unit 101 inches long and 11 inches in maximum diameter. The nose section is spherical at its forward end and the afterbody section is conical, the apex being at the rear. Both the nose and tail sections are attached to the main body by recessed bolts 4. Horizontal stabilizer fins 8 and vertical stabilizer fins 9 support elevators 10 and rudders 11.

A propeller 12 is coupled to a drive motor 13 which is driven by a 12 volt lead-acid battery 14. The drive motor 13 has two speeds which drive the target at 7 knots for launching and 3¾ knots for cruising, the change of speed of the drive motor being controlled by a sequence timer 15, which will be described presently.

The simulated submarine noises are generated by electronic means within the amplifier 6 and projected into the water by means of a sonic loudspeaker 16. These noises are generated at frequencies ranging from 100 cycles per second into the supersonic frequencies. The noises that are simulated include: a gear whine, the fundamental frequency of which is variable between 250 cps to 350 cps, and propeller cavitation noises that are adjustable for simulating noises from propellers operating between 80 and 140 turns per minute. The amplitude of the gear whine is adjustable.

Figure 2:
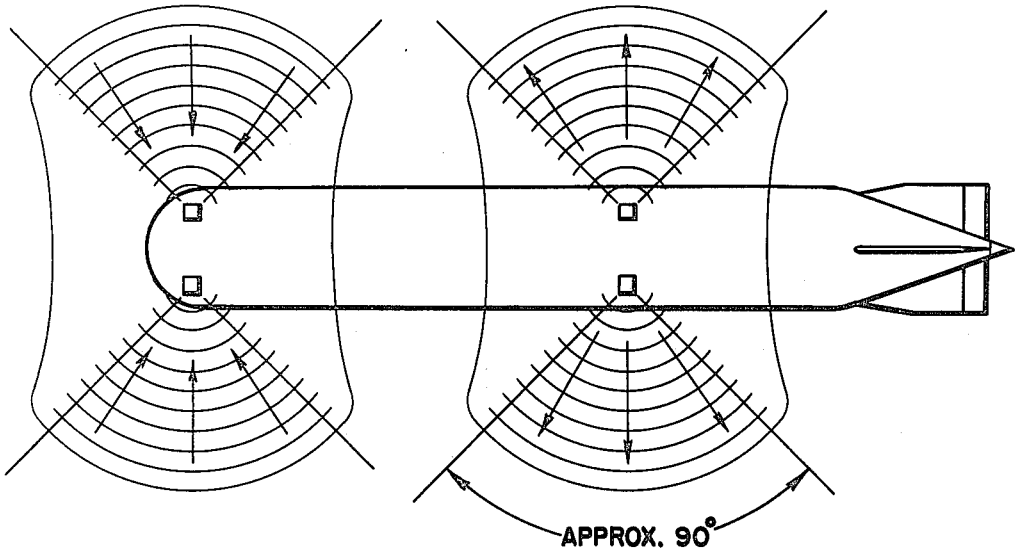
FIGS. 2 and 3 are diagrams showing certain acoustic properties of the device.
Figure 3:
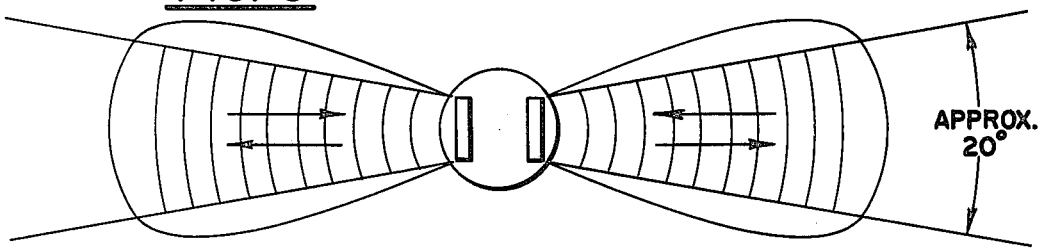

The echo repeater equipment which operates in the supersonic range (as for example from 15 to 30 kilocycles per second) consists of a receiving transducer 5 in the nose, an amplifier 6 and a transmitting transducer 7 in the side of the device, well aft. The receiving transducer 5 and the transmitting transducer 7 are each constructed of two sets of rochelle-salt, Y-cut crystals that have their driving surfaces facing horizontally outboard, perpendicular to the longitudinal axis, so as to give a response pattern as shown in FIG. 2 and FIG. 3. The two sets of crystals in the receiving transducer are connected in parallel 180° out of phase with each other so that their electrical outputs are opposed. The two sets of crystals in the transmitting transducer are connected in a parallel arrangement and operate in phase. The connection of the transducers in this manner reduces acoustical coupling (feedback) between the two units as shown and described in the application of Edwin M. McMillan and William A. Meyers, Ser. No. 497,232, filed Aug. 3, 1943, now U.S. Pat. No. 2,694,868.

As indicated in FIG. 2 and FIG. 3 the response of a repeated signal is strongest in a lateral direction. This characteristic helps to give the device an echo response similar to that of a submerged submarine. That is to say, the strongest echo from a submarine is given off from a beam aspect while echoes of less intensity are given off from bow and stern aspects.

Just aft of the transmitting transducer 7 is a depth control 17 which contains a hydrostatic switch 18 that is operated by external water pressure through an orifice 23 in the bottom of the device. This switch controls two depth control solenoids 19, of which only one is shown in FIG. 1, that actuate the elevators 10. An adjustment screw 20 on the depth control 17 provides a means of pre-setting the depth at which the device will run.

An electric course-control gyro 21 provides a means of keeping the device on a straight course and a course dial 22 on top of the hull provides a means of selecting the course of the device relative to its launched direction. The course setting is adjustable up to 90° left or right of the launched direction. The course control gyro 21 controls solenoids 82 (not shown in FIG. 1) that operate the rudders 11.

An electric clock 24 is mounted in the main body section 2 and a dial 25, graduated from 0 to 10 minutes, for setting the clock is set flush in the top external surface of the device. This so called "silent-run" clock controls the interval of time (up to 10 minutes) that the device will run silent, after launching, before B+ power is supplied to the tubes of the amplifier 6 for the echo repeater and noise generator equipment for activating these sound radiating means.

An electrically driven sequence-timer 15 controls the operation of various units in sequence as will be described presently.

A so called "practice plug" 26 provides a control means for operating the target as a recoverable unit during practice operations. The practice plug 26 is connected in series with an electric relay 95 and a solenoid 96 (to be described in connection with FIG. 5) that release a lead "retriever-weight" 27 that is set in a well or socket in the nose. With the retriever weight 27 attached the target is negatively buoyant but when the retriever weight is dropped at the end of a practice run the device becomes positively buoyant and rises to the surface. For combat operations the practice plug 26 is removed to disable the solenoid 96 and the retriever weight remains attached to cause the target to sink to the bottom when its batteries become exhausted.

Extending through the upper surface of the afterbody 3 (FIG. 1) are three spring-loaded plungers of which only two, 28 and 29, are shown. These plungers are connected to switches 30 and 31 that are used to arm and release the target.

Figure 4:
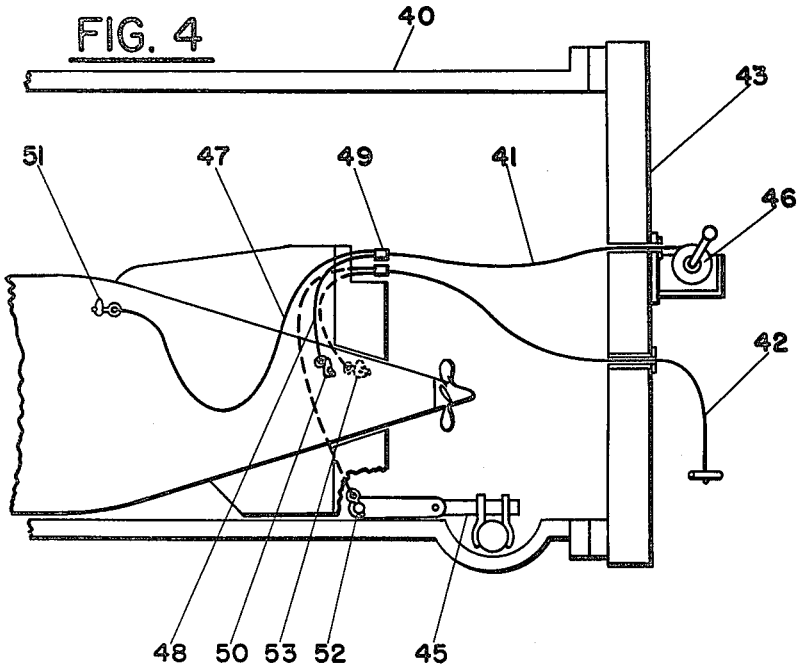
FIG. 4 is a fragmentary view showing the rigging of the device for launching it from a torpedo tube of a submarine.

FIG. 4 shows the arrangement of arming and releasing cables for the present invention when installed in a submarine torpedo tube 40. The arming cable 41, and the releasing cable 42 extend through the breech door 43 of the torpedo tube and each cable is coupled to two short lengths of cable that are connected to pins on the afterbody of the target. The arming cable 41 is operated from a reel 46 and is connected to two short cables 47 and 48. Cable 48 is rigged with less slack than cable 47 and when cable 41 is reeled onto reel 46 the arming pin 50 is pulled, thus setting in operation certain units of the target, which will be explained presently. The so called "simulation-safety-pin" 51 is not pulled at this time because the coupling 49 hits the breech door 43 before the slack in cable 47 is exhausted.

After the release cable 42 is pulled removing simultaneously pin 52 which releases the target from the clamp 45, and pin 53, which closes switch 31 (FIG. 5) that starts the drive motor and timer, the target swims toward the outer end of the torpedo tube, during which time cable 41 is drawn from the reel 46. When the target clears the end of the torpedo tube the cable 41 is completely unreeled and being fastened to the reel 46 applies sufficient pull on the cable 47 to pull the pin 51 and close the simulation safety switch. At the closing of the simulation switch the "silent run" clock is started as previously described. Thus the echo repeater and sonic simulation apparatus are not set in operation until the target has cleared the torpedo tube so as to avoid any danger of the target radiating noises while in the tube.

Operation of the component parts of the present invention are as follows: The pulling of the arming pin 50 by cable 48 as already described, closes arming switch 60 (FIG. 5) to connect power through line 61 to the amplifier filaments and at the same time connects power through line 63 and switch 64 to the sequence-timer motor 70 and the gyro rotor motor 71. After the sequence timer runs for 45 seconds the switch 65 is moved to its opposite position, thereby stopping the sequence-timer motor 70. This 45-second period is provided between the arming and releasing operations to allow the gyro rotor 71 to come up to operating speed and the amplifier filaments to warm up before the target can be released.

Figure 5:
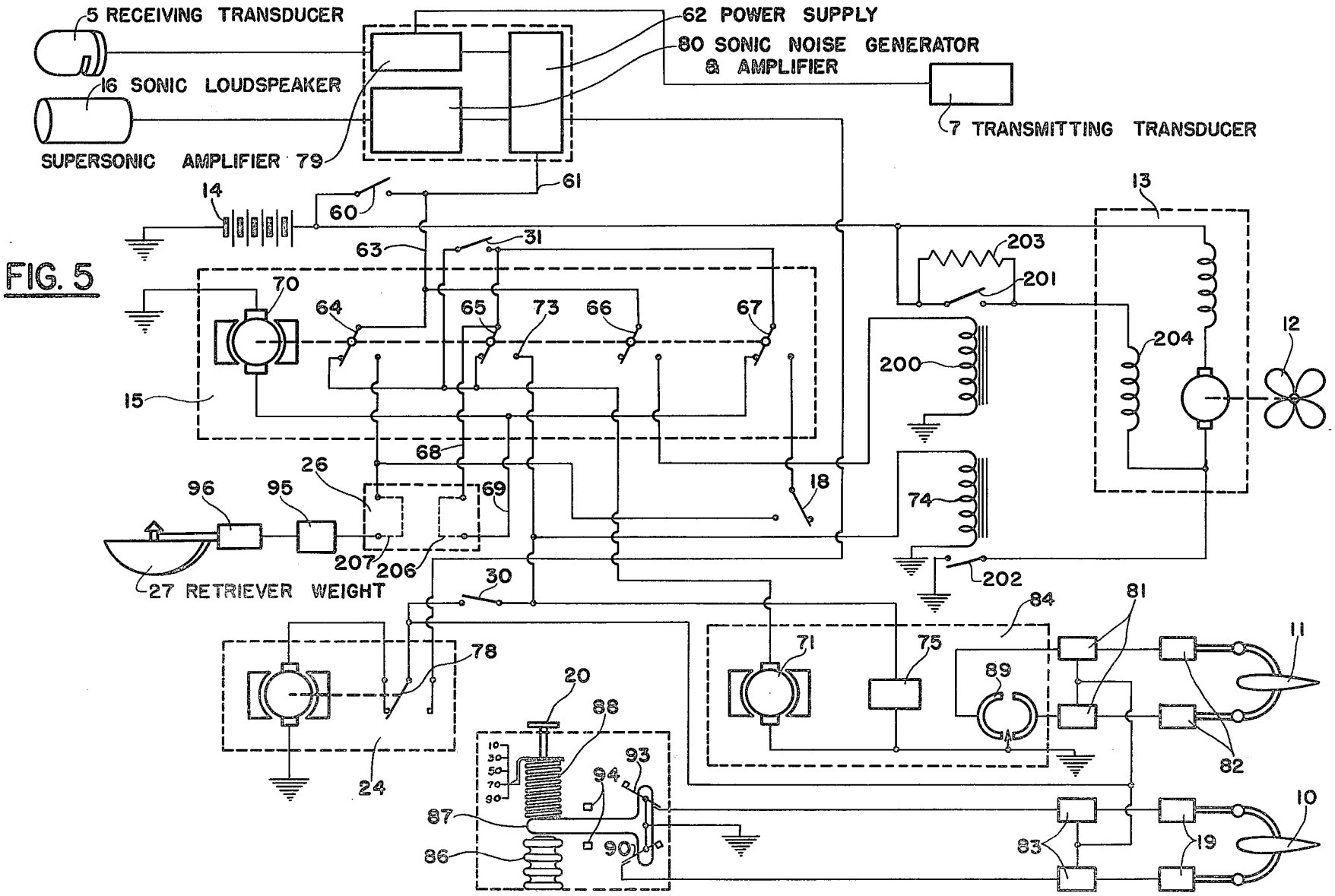
FIG. 5 is a schematic diagram of the electric circuits of the device.

Thereafter when lanyard 42 (FIG. 4) is pulled, switch 31 in FIG. 5 closes to supply power through switch 65, (which is now contacting terminal 73) to the drive motor starting relay 74, to the gyro uncaging solenoid 75, and to the "simulation safety switch" 30, which is still open. Relay 74 closes switch 202 which energizes the drive motor 13 to propel the target at high speed for launching (approximately 7 knots). When the target reaches the end of the torpedo tube the simulation safety switch 30 is closed by cable 41 as previously explained, and power is supplied to the "silent-run" clock 24 which runs for a pre-set time before closing switch 78 which supplies power to the power supply 62 which in turn supplies B+ power to the tubes of amplifiers 79 and 80. The silent run period of the target after leaving the torpedo tube is important in combat operations for concealing the location of the launching submarine. The target does not begin transmitting noise or repeating pings until the end of the silent run period, during which time the submarine and the target can move a considerable distance apart.

At the closing of the simulation safety switch 30 the course control relays 81 and the depth control relays 83 are energized, thereby completing the circuits for the operation of the course control unit 84 and the depth control unit 17. The course control unit 84 is a gyroscopic mechanism employing an electrically driven gyro rotor 71 and a stator 89 having a course selector dial on top of the target permitting adjustment for a course up to 90° to left or right of the launched direction.

The depth control unit 17 employs a pair of mercury switches 90 and 93 that are operated by water pressure in connection with a spring 88 which regulates the movement of an arm 87 which supports the mercury tubes. An adjustment screw 20 provides a means of regulating the force of said spring against the arm 87 and a scale attached to the adjustment screw 20 provides an index for setting the spring pressure to operate the target at a desired depth.

Figure 6:
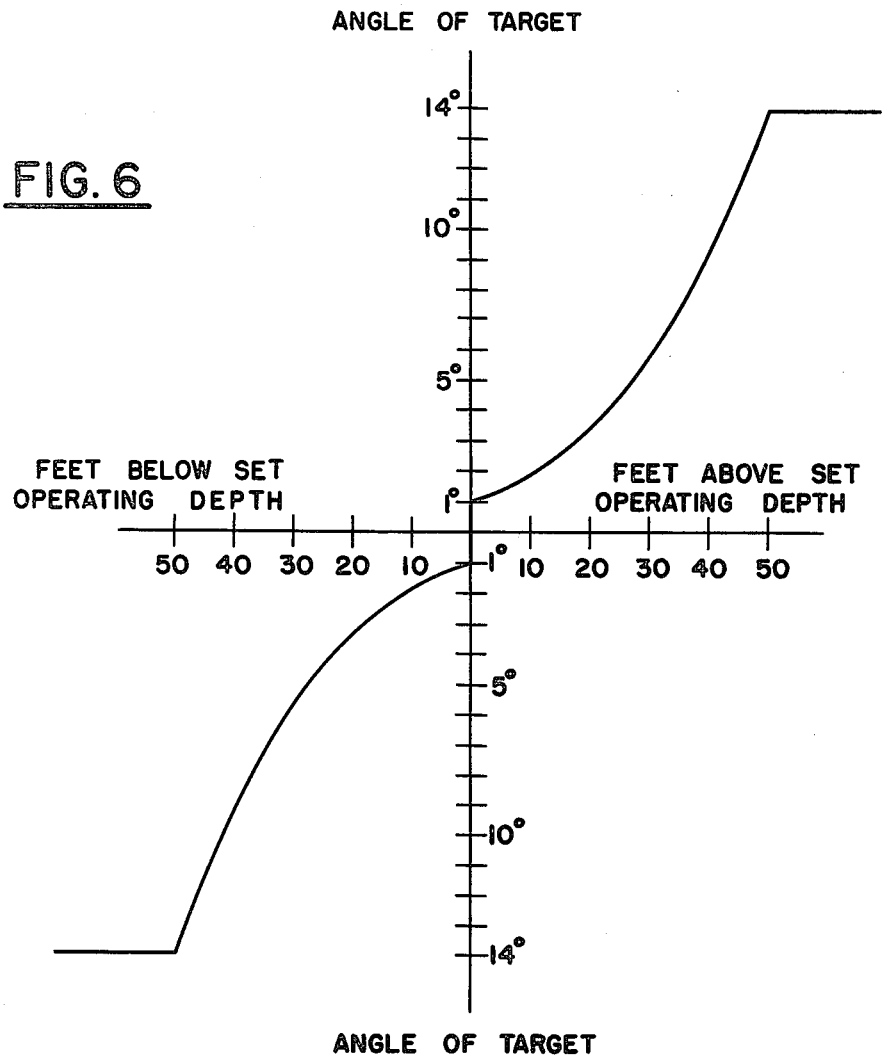
FIG. 6 is a graph for explaining the operation of the depth control.

The mercury switches 90 and 93 are so adjusted that they energize one or the other of elevator solenoids 19 whenever arm 87 is 1° or more from a horizontal position. Thus the mercury switches, by controlling elevator 10, will tend to regulate the angle of climb or dive of the target so as to hold the arm 87 in a level position. Should the target be launched from, or otherwise attain, a depth that is not the same as the setting of the adjustment screw 20, the difference in the water pressure for the depth set on screw 20 and the water pressure at the target depth in the bellows 86 will move the arm 87 so that it lies at an angle to the axis of the hull. Thereupon the mercury switches 90 and 93 so control elevator 10 as to return arm 87 to a level position and thereby put the target into a climb or dive. The movement of the arm 87 is limited by stops 94 to 14° above or below the longitudinal axis of the target, thereby limiting the angle of climb or dive of the target to a like figure. Maximum movement of the arm 87 is obtained only when the water pressure in the bellows 86 is equivalent to a depth error of 50 ft. or more from the setting of the adjustment screw 20. Water pressure differences equivalent to an offsetting depth of less than 50 ft. will move the arm 87 a part of its 14° travel as shown in FIG. 6. Thus the depth control can be said to have proportional characteristics in that it gradually reduces the angle of climb or dive as the target approaches its proper depth and prevents overcontrol or "searching."

One minute after the target is launched, switch 66 closes and power is supplied to relay 200 which closes switch 201. Closing switch 201 shorts out resistor 203, which is in series with the drive motor field winding 204, and reduces the speed of the target to 3.75 knots, which is a reasonable speed for a submerged submarine. The 7 knot speed is necessary during the launching period to allow the target to clear the submarine when the target is launched from a bow torpedo tube while the submarine is moving ahead.

Five minutes after launching the target the switch 67 is moved to its opposite position, thus supplying power to a hydrostatic switch 18. The hydrostatic switch is set to close when the target is below the 100-foot depth and is set to open above this depth. The hydrostatic switch is connected to the retriever-weight-release-solenoid 96 and is a safety device that prevents the target from sinking to a depth greater than 100 feet during practice runs. Since the target may be launched from a submerged depth of greater than 100 feet, and the normal operating depth is between 10 and 90 feet, the switch 67 delays the operation of the hydrostatic switch 18 for five minutes after launching to allow the target to climb to the set operating depth. The response of the sequence-timer motor 70 and the retriever weight solenoid 96 to the moving of switch 67 depends on the setting of the practice plug 26 which consists of jumper 206 for the sequence-timer motor circuit and a jumper 207 for the retriever weight release circuit. With the practice plug installed, as in a practice run, the sequence-timer motor continues to run since power is taken from switch 65, through lead 68, jumper 206, lead 69, and is connected to the sequence-timer motor 70. The hydrostatic switch 18 is connected through the jumper 207 to the retriever weight release solenoid 96. When jumpers 206 and 207 are removed for a combat run the sequence-timer motor 70 and the retriever-weight-release-solenoid 96 are disconnected from any source of power and the target will continue to operate until the battery is exhausted and the target sinks.

On a practice run, twenty minutes after the target is launched, switch 64 is moved to the opposite position and the retriever-weight-release-solenoid 96 is energized, the weight 27 is dropped and the target returns to the surface. The retriever weight release mechanism consists of a shoulder on the retriever weight 27 which is engaed by a sliding spring-loaded armature of the solenoid 96. Since the retriever weight has a density greater than water, when the solenoid is energized, the weight falls free of the target. The weight and balance of the target are substantially effected by the release of the retriever weight because the weight is located in the nose of the target and its release not only makes the target positively buoyant, but also lightens the nose of the target so that forward movement will tend to drive the target to the surface. After each practice run, as previously explained, cams in the sequence timer 15 must be re-set and a new retriever weight and recharged battery must be installed.

Figure 7A:
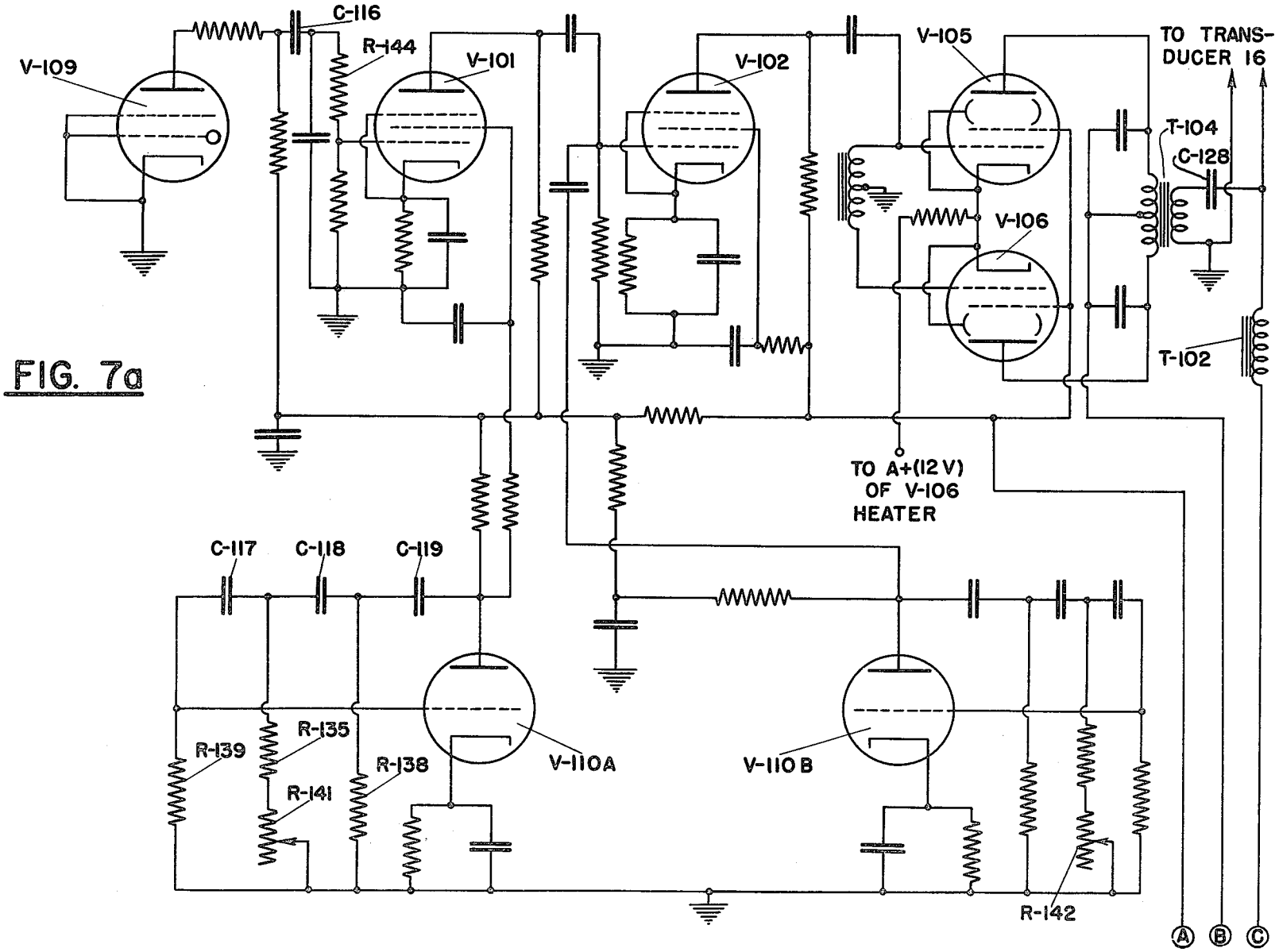
FIG. 7 is a circuit schematic of the electronic part of the device. This figure is shown in two sections labeled *7a* and *7b*.
Figure 7B:
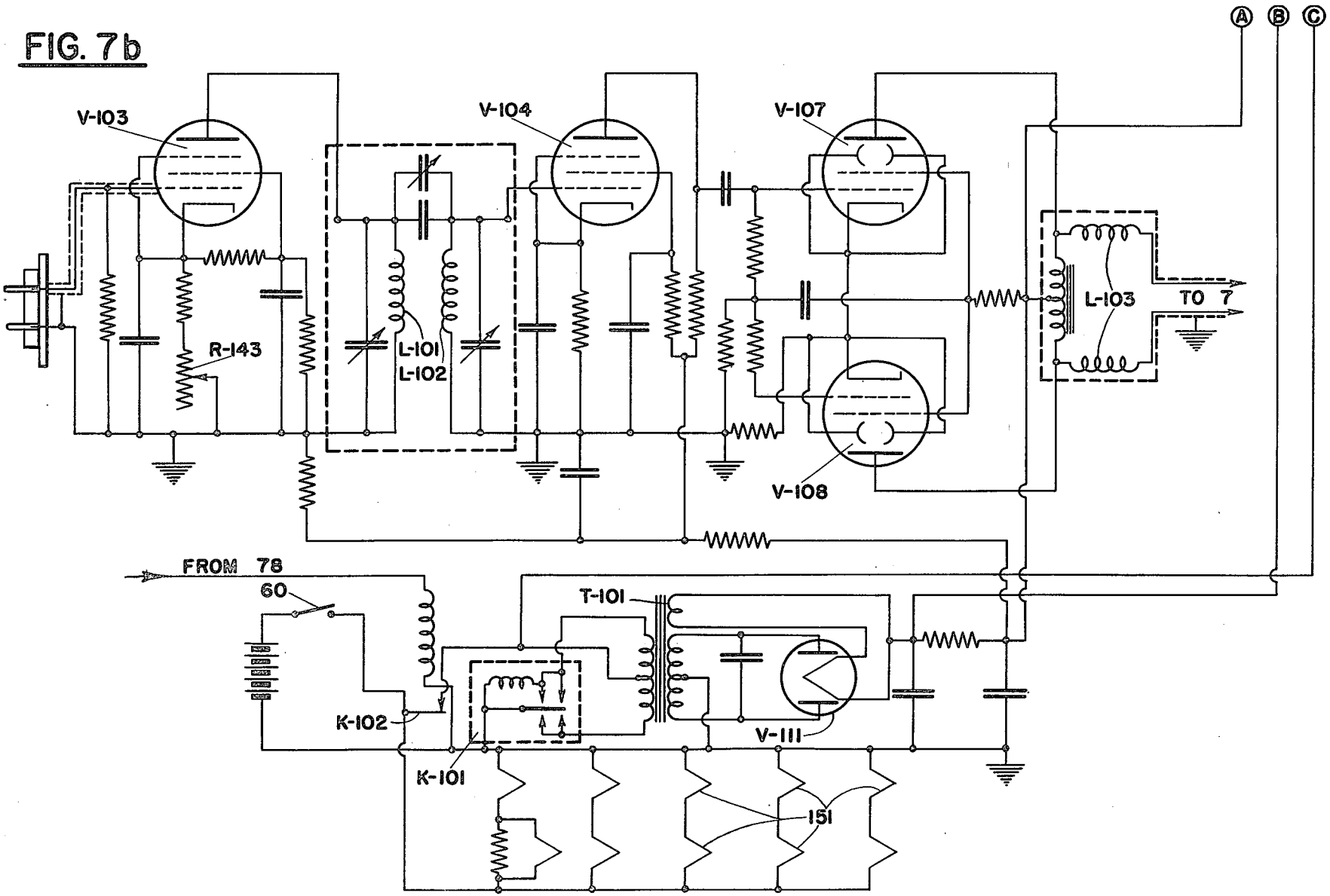

FIG. 7 shows the electronic circuits. The upper part of this figure shows the generator for the simulated self-noise. Electronic tube V-109 is a type 2050 gas-filled, and is operated in its fired condition to serve as a generator of wide band noise. This noise output is delivered through coupling condenser C-116 and resistor R-144 to the first grid of pentode amplifying tube V-101, which tube also receives a modulating signal from V-110A. This latter tube operates as an oscillator in which the plate voltage is passed through three stages of phase shift and applied to the grid for sustaining oscillations. The first stage of phase shift is accomplished by condenser C-119 and resistor R-138, the second by condenser C-118 and resistors R-135 and R-141, and the third stage by condenser C-117 and resistor R-139. Resistor R-141 is adjustable to control the frequency of oscillation between 80 and 140 cycles per minute. The plate signal from this tube V-110A is applied to the second grid or screen grid of tube V-101 as already mentioned for modulating the wide band noise that originates in tube V-109. This modulated noise output of tube V-101 simulates the cavitation noise of the propellers of a submarine. Accordingly, the frequency adjustment at resistor R-141 controls the r.p.m. of the simulated propeller noise.

Tube V-110B, also operating as a phase shift oscillator, generates a simulated gear-whine. Resistor R-142 adjusts the oscillation frequency between 270 and 360 cycles per second. The operating frequency of both oscillators V-110A and V-110B are intended to be preset and not to be altered during a run of the target.

The simulated propeller sound from V-101 and the gear whine from V-110B are both applied to the input grid of amplifier V-102. This tube drives a push-pull stage consisting of tubes V-105 and V-106 which in turn deliver the noise signals through transformer T-104 and a condenser C-128 to the magnetostriction transducer 16 (FIGS. 1 and 5). A polarizing voltage for transducer 16 is supplied at 12 volts d.c. from the power supply through choke T-102. This choke prevents the polarizing circuit from shunting the noise signal, and condenser C-128 keeps the polarizing current out of transformer T-104.

The amplifier for the echo repeater is shown in the center of FIG. 7. The input signal from receiving transducer 5 (FIGS. 1 and 5) is amplified at V-103, is passed through a filter circuit which includes separate inductors L-101 and L-102, is further amplified at V-104 and in the push-pull stage V-107, V-108, and then is delivered through filter chokes L-103 to the output transmitting transducer 7 (FIGS. 1 and 5). Resistor R-143 in the cathode circuit of the tube V-103 constitutes an adjustment for the gain of this amplifier. The filters in the amplifier are designed to give the amplifier a desirable frequency characteristic which when combined with the frequency characteristics of the transducers 5 and 7 will provide a substantially uniform response for the repeater system over a suitably wide band in the supersonic range, as for example over the frequency range, from 15 to 30 kilocycles per second.

The power supply for the electronic circuits is shown at the bottom of FIG. 7. When the arming switch 60 (FIG. 5) is closed, 12 volts d.c. is applied to heaters 151 of all the electronic tubes. When the silent run switch 78 (FIG. 5) closes, it energizes the coil of relay K-102 for applying power to vibrator K-101. This vibrator delivers a.c. to transformer T-101, the output of which is rectified at V-111 for supplying B power to the electronic circuits.

Although illustrated here by its embodiment in a specific construction, the invention is capable of modifications and variations within the scope of the appended claims.

We claim:

1. In combination in electronic apparatus for simulating the self-noise of a submarine, means for generating a wide-band noise signal, means for modulating the noise signal at a frequency corresponding to the propeller speed of a submarine, means for generating a signal at the frequency of the tooth impacts of the main drive gear of a submarine, and amplifying and output means for both said tones.

2. In combination in a self-noise generator for a decoy-submarine, a gas-filled electronic tube for generating a wide-band noise signal, a modulator valve for modulating said signal, a first oscillator operating at a propeller-beat frequency for controlling said modulator, a second oscillator operating at a frequency corresponding to the tooth-impact frequency of a submarine's main drive gear, and amplifier means for amplifying the outputs of said modulator and said second oscillator.

3. In a free sound-decoy for simulating a submarine, a self-propelled underwater craft having a hull, means within said hull comprising a receiving transducer for receiving water-borne sounds, means including a radiating projector for amplifying and reradiating said received sounds which simulate the reflective properties of a submarine, electronic means for generating and radiating multiple noises simulating the self-noise of a submarine, said electronic means including a gas-filled electronic tube for generating a wide-band noise signal, a first oscillator producing a signal of a propeller-beat frequency, modulating means connected to said gas-filled electronic tube and said first oscillator to superimpose said signal of a propeller-beat frequency on said wide-band noise signal a second oscillator operating at a frequency corresponding to the tooth-impact frequency of a submarine's gear mechanism, means for amplifying the outputs of said modulating means and said second oscillator, and means for radiating the output of said amplifying means.

4. A device for simulating a submarine comprising, a self propelled cylindrical body having directional and depth control mechanism, first and second hydrophones secured to said body in spaced relationship, an amplifier interconnecting said first and second hydrophones to reproduce the reflective properties of a submarine, and means for reproducing the noises of a submarine, said means comprising a first oscillator having a frequency corresponding to the propeller-beat of a submerged submarine, a second oscillator producing a frequency corresponding to the gear whine of a submarine, a third oscillator producing wideband noise, mixing means for combining and amplifying the outputs of said first, second, and third oscilators to produce a noise signal, and a third hydrophone for radiating the noise signal.

* * * * *